US007516519B2

(12) United States Patent
Talpe

(10) Patent No.: US 7,516,519 B2
(45) Date of Patent: Apr. 14, 2009

(54) DOOR OR GATE CLOSING HINGE

(76) Inventor: Joseph Talpe, Oudenaardsesteenweg 543, Avelgem-Kerkhove (BE) 8581

( * ) Notice: Subject to any disclaimer, the term of this patent is extended or adjusted under 35 U.S.C. 154(b) by 257 days.

(21) Appl. No.: 10/595,578

(22) PCT Filed: Nov. 3, 2004

(86) PCT No.: PCT/EP2004/052787

§ 371 (c)(1),
(2), (4) Date: Apr. 28, 2006

(87) PCT Pub. No.: WO2005/042892

PCT Pub. Date: May 12, 2005

(65) Prior Publication Data

US 2007/0113378 A1 May 24, 2007

(30) Foreign Application Priority Data

Nov. 3, 2003 (BE) ..... 2003/0587

(51) Int. Cl.
*E05F 1/02* (2006.01)

(52) U.S. Cl. ..... 16/316; 16/299; 16/300; 16/76

(58) Field of Classification Search ..... 16/298, 16/299, 300, 301, 79, 75, 76, 308, 316; 49/386
See application file for complete search history.

(56) References Cited

U.S. PATENT DOCUMENTS 1,265,416 A * 5/1918 Andre ..... 16/79
1,374,437 A * 4/1921 Coombs ..... 16/313
2,629,881 A * 2/1953 Young ..... 4/240
2,807,043 A 9/1957 Gordon
4,951,351 A * 8/1990 Eckel ..... 16/284
6,425,205 B2 * 7/2002 Wygle et al. ..... 49/349
6,618,902 B2 * 9/2003 Wu ..... 16/298

FOREIGN PATENT DOCUMENTS

| | | | |
|---|---|---|---|
| EP | 542034 A1 | | 5/1993 |
| FR | 1016363 | | 11/1952 |
| GB | 2099497 A | * | 12/1982 |
| WO | WO 02/33205 A1 | | 4/2002 |

* cited by examiner

*Primary Examiner*—Victor Batson
*Assistant Examiner*—Jeffrey O'Brien
(74) *Attorney, Agent, or Firm*—Sughrue Mion, PLLC

(57) ABSTRACT

The adjustable self-closing hinge (1) comprises a first hinge part (2), a second hinge part (3), a hinge shaft (10), a torsion spring (18) having a first end (19) fixed with respect to the first hinge part (2) and a second end (20) fixed with respect to the hinge shaft (10) to exert a moment onto the first hinge part, and means for adjusting the moment exerted by the torsion spring on the first hinge part. These adjusting means comprise a coupling element (21) which is interposed between the first end (19) of the torsion spring (18) and the first hinge part (2) and which is rotatably mounted in the first hinge part, and a screw-like element (24) which is rotatably mounted in the first hinge part (2) and which is arranged to cooperate with the coupling element (21) to rotate the coupling element with respect to the first hinge part so as to adjust the moment exerted by the torsion spring on the first hinge part.

12 Claims, 6 Drawing Sheets

DOOR OR GATE CLOSING HINGE

BACKGROUND OF THE INVENTION

The present invention relates to a gate or door closing hinge comprising a first hinge part, a second hinge part, a hinge shaft rotatably mounted about a first rotation axis in the first hinge part and connecting the first hinge part to the second hinge part, a torsion spring having a longitudinal axis coinciding substantially with said first rotation axis and having a first end fixed with respect to the first hinge part and a second end fixed with respect to the hinge shaft to exert a door or gate closing moment onto the first hinge part, and means for adjusting the moment exerted by the torsion spring on the first hinge part.

Hinges comprising a torsion spring for closing the door or gate against which they are mounted are known. When assembling the hinges, the torsion spring is pre-tensioned so that the door or gate has to be opened against a predetermined spring tension. In practice, there exist moreover systems for adjusting the tension of the torsion spring when the hinges are already mounted on the door or gate. An example of such a system are the TRU-CLOSE® adjustable self-closing gate hinges which are available on the market.

The TRU-CLOSE® adjustable self-closing gate hinges are mounted in the same way as conventional hinges on the outside of the gate and the pole. The torsion spring is arranged within the hinge, around the hinge shaft. The hinge shaft has a hexagonal head which fits in a cavity in the second hinge part. By means of a screwdriver, the hexagonal head can be depressed against the action of the helical torsion spring and rotated to adjust the tension of the torsion spring. In this way a quite compact adjusting system is achieved. A drawback of such an adjustment system is however that, when depressing the head of the hinge shaft, the screwdriver has to be held very strongly and a large force has to be exerted thereon in order to be able to increase the tension of the torsion spring. Indeed, when depressing the hexagonal head, the entire tension of the torsion spring acts upon the screwdriver.

SUMMARY OF THE INVENTION

An object of the present invention is now to provide a new type of self-closing hinges which comprise a torsion spring, the tension of which can be adjusted more easily, i.e. without having to hold the entire tension of the torsion spring when adjusting the tension, and which can be kept relatively compact.

To this end, the hinge according to the invention is characterised in that the means for adjusting the moment exerted by the torsion spring on the first hinge part comprise a coupling element, which is interposed between the first end of the torsion spring and the first hinge part and which is rotatably mounted in the first hinge part about a second rotation axis which coincides substantially with the first rotation axis, and a screw-like element which is rotatably mounted in the first hinge part about a third rotation axis and which has a screw threaded portion arranged to co-operate with the coupling element to rotate the coupling element with respect to the first hinge part upon rotation of the screw-like element about the third rotation axis so as to adjust the moment exerted by the torsion spring on the first hinge part.

In the lock according to the invention, the moment exerted by the torsion spring on the first hinge part, in other words the spring tension, can be easily adjusted by rotating the screw-like element by means of a screwdriver or a spanner. The screw threaded portion on the screw-like element provides for a connection between the coupling element and the first hinge part which maintains the coupling element in position with respect to the first hinge part and which enables moreover to adjust this position without having to disconnect the coupling element from the first hinge part. The tension of the torsion spring is therefore always taken up by the first hinge part, even when adjusting this tension by rotating the screw-like element. Moreover, since the tension of the torsion spring is adjusted indirectly by rotating the coupling element by means of the screw threaded portion on the screw-like element, a smaller force has to be exerted by means of the screwdriver or the spanner onto the screw-like element than the force which has to be exerted onto the torsion spring itself to increase the tension thereof. The angular displacement of the torsion spring will indeed be smaller than the corresponding angular displacement of the screw-like element. A further advantage of the hinge according to the invention is that the adjustment system with coupling element and screw-like element can be kept relatively compact.

In a first particular embodiment of the hinge according to the invention, the coupling element has a helical guide, in particular a helical groove, extending around the second rotation axis and the screw-like element co-operates with the coupling element through the intermediary of a guided element arranged to move along said helical guide upon rotation of the screw-like element to rotate the helical guide and hence the coupling element with respect to the first hinge part.

An advantage of this embodiment is that the screw-like element can be arranged in a direction parallel to the rotation axis of the hinge shaft so that the tension of the torsion spring can be adjusted from the upper side of the hinge. Such an embodiment enables for example to mount the first hinge part within a vertical tube element of the door or gate whilst still enabling an adjustment of the spring tension in the mounted state of the hinge without having to drill a lateral hole in the tube element.

In a second particular embodiment of the hinge according to the invention, the coupling element comprises a worm wheel and the screw threaded portion of the screw-like element forms a worm cooperating with the worm wheel of the coupling element to rotate the coupling element with respect to the first hinge part upon rotation of the screw-like element.

An advantage of this embodiment is that the coupling element can be rotated as much as desired by means of the screw-like element, i.e. the number of rotations of the coupling element and thus of the torsion spring are not limited by the adjustment system.

In a preferred embodiment of the hinge according to the invention, the first hinge part comprises a tubular housing enclosing at least the hinge shaft, the torsion spring and the coupling element, the tubular housing of the first hinge part being in particular arranged to be mounted in a tubular element fixed against the door or gate or in a tubular frame member of the gate or door itself.

Due to the fact that in the hinge according to the invention the adjustment mechanism can be kept relatively compact, this preferred embodiment offers the advantage that the first hinge part and all the components of the hinge enclosed thereby can be mounted in a tubular element mounted against the door or gate or even in a tubular vertical frame member of the door or gate itself. The advantage of mounting the first hinge part in a tubular vertical element is that the self-closing system is vandal proof and hidden from view. The interior of the vertical frame member offers further a long cavity so that the length of the first hinge part, and especially the length of the torsion spring, can be increased without achieving an aesthetically not acceptable hinge. By being free to choose the length of the torsion spring, this length (i.e. the number of windings) can be selected in view of the desired spring properties. Moreover, it is possible to increase also the length of the hinge shaft and to add one or more additional torsion springs underneath the first torsion spring between the hinge shaft and the first hinge part to increase the spring tension for example when the hinge is applied to a larger and heavier door or gate.

BRIEF DESCRIPTION OF THE DRAWINGS

Other particularities and advantages of the invention will become apparent from the following description of some particular embodiments of self-closing hinge according to the present invention. The reference numerals used in this description relate to the annexed drawings wherein.

DETAILED DESCRIPTION

Figure 1:
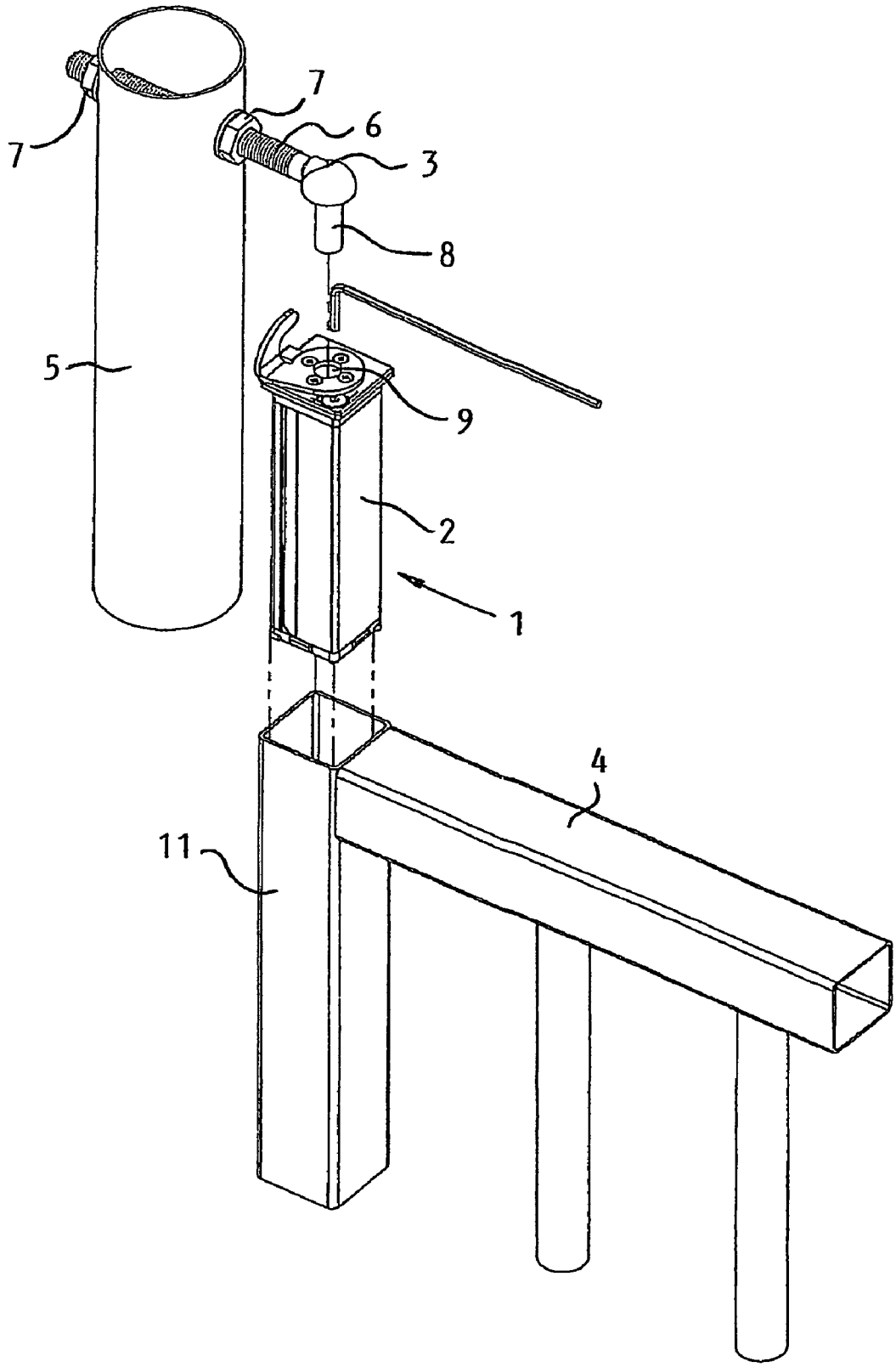
FIG. 1 shows an exploded view on a portion of a gate, on a first hinge part arranged to be mounted in a tubular vertical frame member of the gate, and on a second hinge part mounted on a vertical pole.
Figure 2:
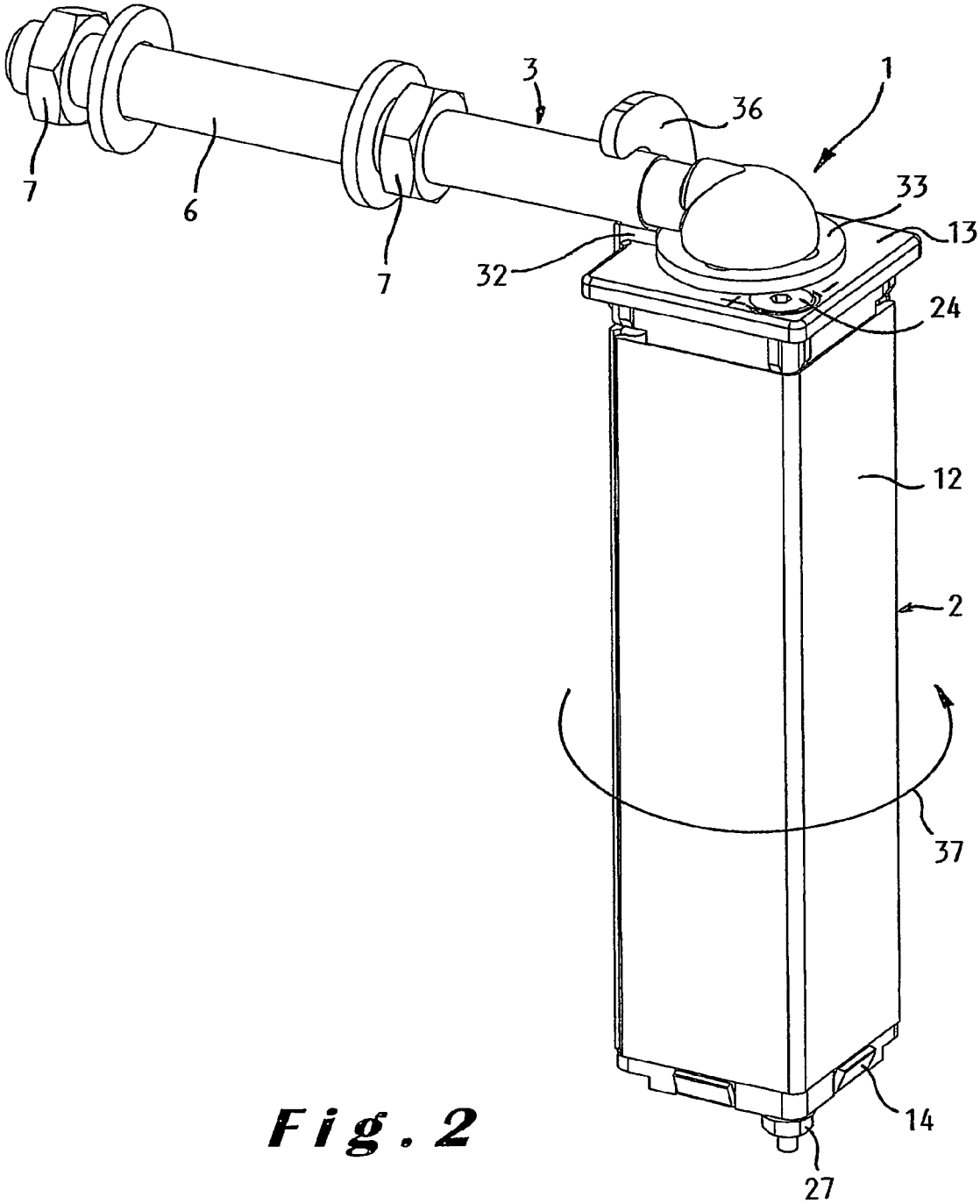
FIG. 2 shows the first and the second hinge part illustrated in FIG. 1 in their mounted state.

The adjustable self-closing hinge 1 illustrated in FIG. 1 comprises a first hinge part 2 arranged to be mounted to a door or gate and a second hinge part 34 arranged to be mounted to a vertical support, in particular to a pole 5.

The second hinge part 3 is generally L-shaped. One leg of the L-shape is formed by a bolt portion 6 applied through two opposite holes in the pole and fixed to the pole 5 by means of two nuts 7, one on each side of the pole 5. The other leg of the L-shaped hinge part 3 is a cylindrical shaft 8 which fits in a cylindrical hole 9 provided, as explained hereinafter, in the upper side of the actual hinge shaft 10 received in the first hinge part 2.

The first hinge part 2 has a tubular shape so that it can be mounted in a vertical tubular member 11 of the door or gate 4. In the mounted state, the first hinge part 2 is thus hidden from view. A further advantage of mounting the first hinge part in the tubular gate member is that the hinge is more vandal proof. The length of the tubular gate member 11 enables moreover to increase the length of the first hinge part 2 and of all the components of the hinge enclosed thereby. A problem with mounting the first hinge part 2 and the hinge components rendering the hinge self-closing and adjustable is however that the tubular gate member has a relatively small diameter (for example a diameter of 40 mm) so that the hinge has to be of a relatively compact construction.

Figure 3:
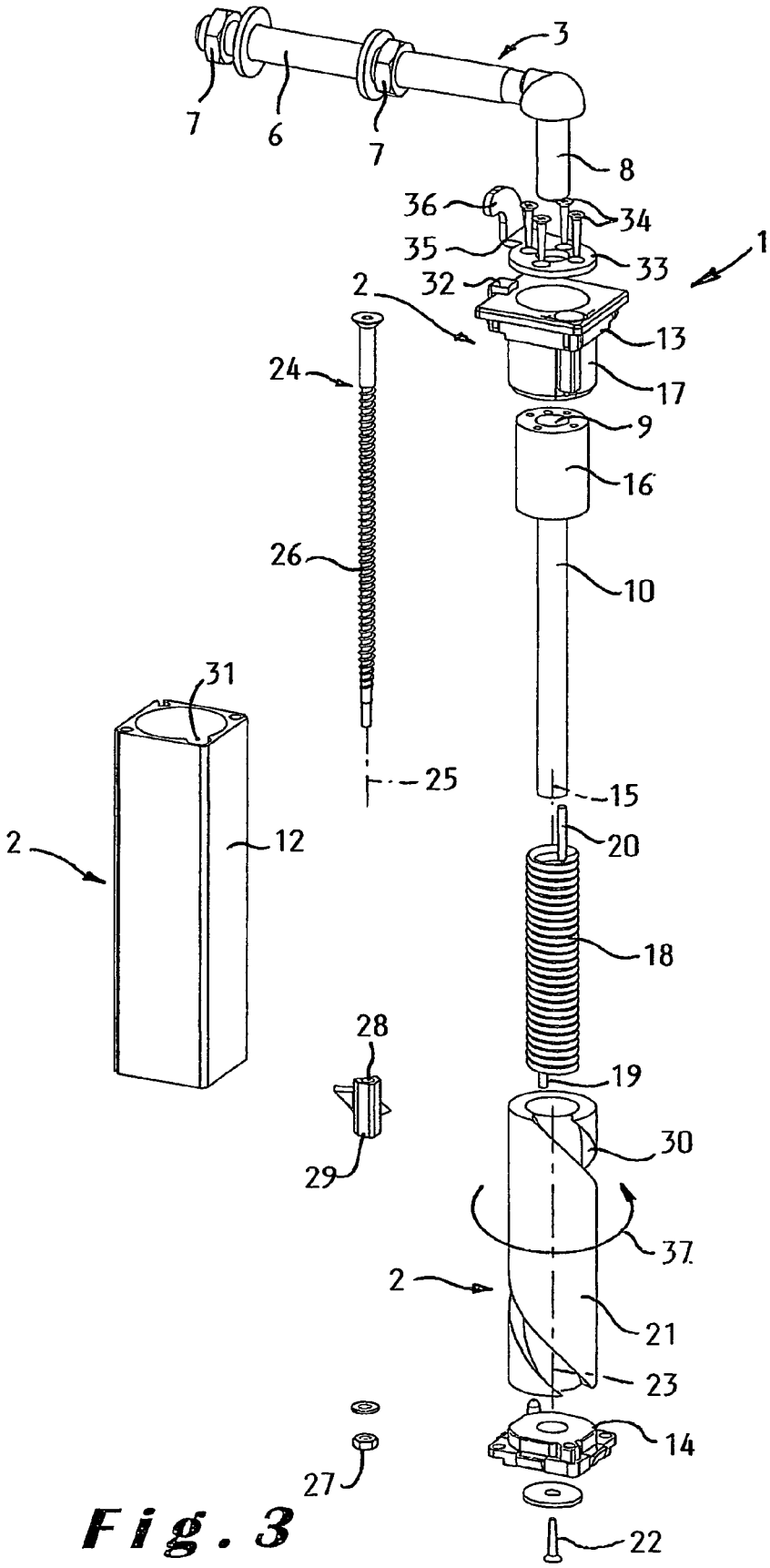
FIGS. 3 and 4 show exploded views of the self-closing hinge illustrated in FIG. 2.
Figure 4:
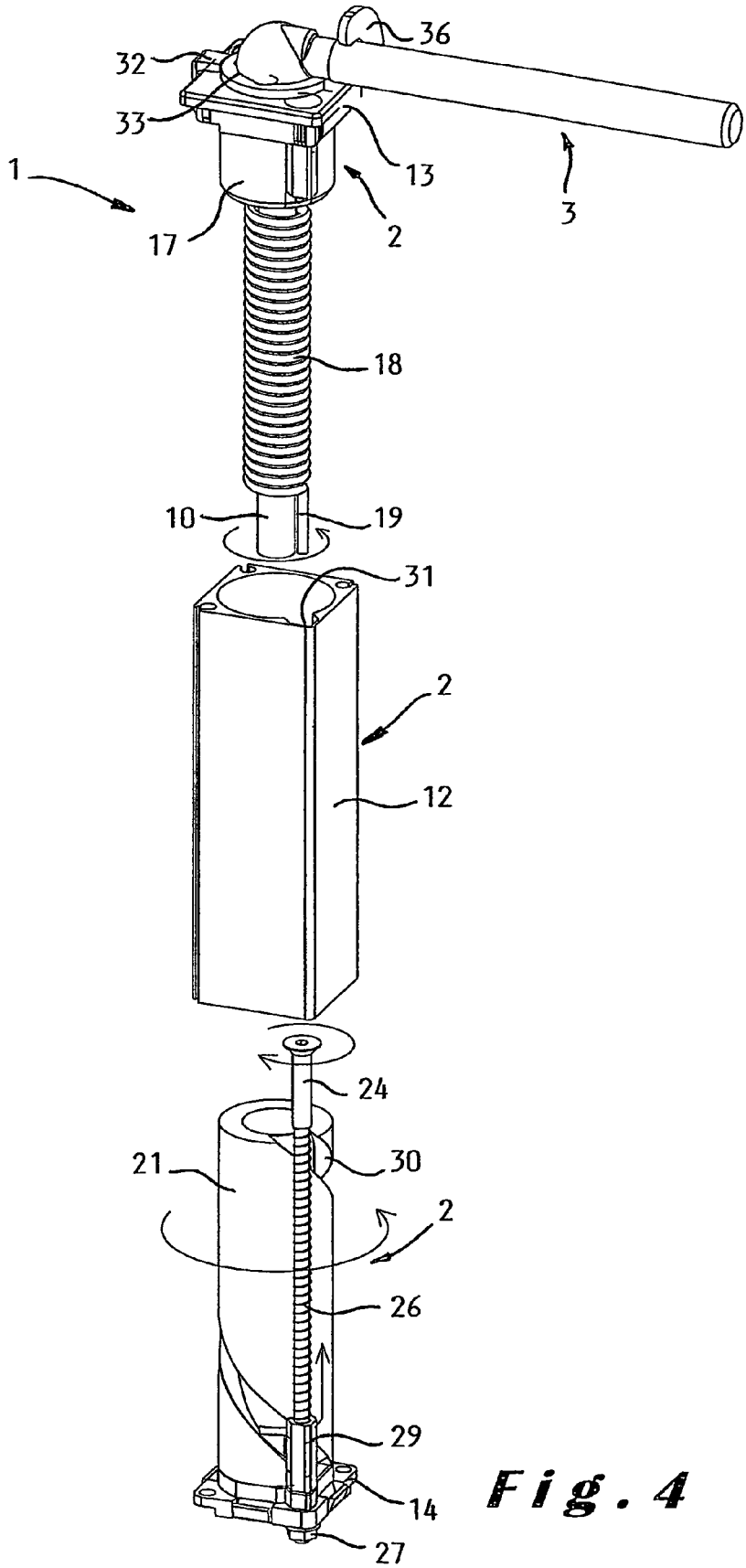

As illustrated more into detail in FIGS. 3 and 4, the first hinge part 2 comprises a tubular housing 12, a top part 13 arranged to be fixed to the top of the tubular housing 12 and a bottom part 14 arranged to be fixed to the bottom of the tubular housing 12. The actual hinge shaft 10 is rotatably mounted about a first rotation axis 15 in the first hinge part 2. The hinge shaft 10 has more particularly a thickened cylindrical head portion 16 which fits in a cylindrical cavity formed by a downward collar 17 on the top part 13 of the first hinge part 2.

To render the hinge self-closing, a helical torsion spring 18 is applied over the hinge shaft 10 so that its longitudinal axis coincides with the first rotation axis 15. The torsion spring 18 has a first end 19 fixed with respect to the first hinge part 2 and a second end 20 fixed with respect to the hinge shaft 10 (the second end 20 of the spring 18 is arranged in a hole (not shown) in the bottom of the head portion 16 of the hinge shaft 10) to exert a moment onto the first hinge part 2. In this way, the first hinge part 2 rotates against the action of the torsion spring 18 with respect to the hinge shaft 10 when opening the door or gate 4 and the door or gate 4 is closed back under the action of the torsion spring 18.

In order to enable to adjust the tension of the torsion spring 18, the first end 19 of the torsion spring is not fixed directly to the first hinge part 2 but is fixed thereto through the intermediary of a coupling element 21. This coupling element 21 has a generally cylindrical tubular shape and is applied in the housing portion 12 of the first hinge part 2 over the torsion spring 18. The coupling element 21 fits in the tubular housing 12 of the first hinge part 2 and is rotatably fixed to the bottom part 14 thereof by means of a screw 22. The coupling element 21 can rotate in the housing 12 about a second rotation axis 23 which coincides with the first rotation axis 15 of the hinge shaft 10. The first end 19 of the torsion spring 18 is applied in a hole (not shown) in the bottom of the coupling element 21 so that the (pre)tension of the torsion spring 18 can be adjusted by rotating the coupling element 21 with respect to the hinge shaft 10 without rotating the first hinge part 2 with respect to the hinge shaft.

In order to enable to achieve this rotation of the coupling element 21 with respect to the hinge shaft 10 and with respect to the first hinge part 2, the adjusting means further comprise a screw-like element 24 which is rotatably mounted in the first hinge part 2 about a third rotation axis 25 parallel to the first rotation axis 15. The screw-like element 24 extends through holes in the top 13 and bottom parts 14 of the first hinge part 2 and is fixed underneath the bottom part 14 by means of a nut 27 so that it can only rotate in the first hinge part but not move up or down. The screw-like element 24 has a screw threaded portion 26 which is screwed in an internally screw-threaded hole 28 in an element 29 guided in a helical guide, more particularly in a helical groove 30, on the outer surface of the coupling element 21. The element 29 is further guided in a linear guide, more particularly a linear groove 31, on the inner side of the tubular housing 12 of the first hinge part 2. This linear groove 31 extends parallel to the rotation axis 25 of the screw-like element 24 whilst the helical groove 30 in the coupling element 21 extends around the rotation axis 23 of the coupling element 21. By rotating the screw-like element 24 in the guided element 29, this guided element 29 can be moved up and down in the linear groove 31 in the first hinge part 2 and at the same time in the helical groove 30 in the coupling element 21 thereby rotating the coupling element 21 with respect to the first hinge part 2 and thus adjusting the tension of the torsion spring 18.

Due to the fact that the guided element 29 cannot move up or down by the presence of the screw-like element 24 the coupling element 21 is constantly blocked in a particular angular position with respect to the hinge shaft 10, even when adjusting the tension of the torsion spring 18 by rotating the screw-like element 24. This screw-like element 24 is prevented from bending by the fact that the guided element is guided in the linear groove 31 in the first hinge part 2. In this way, a relatively thin screw-like element and a relatively small guided element can be used whilst still assuring a reliable connection between the coupling element 21 and the first hinge part 2.

In the embodiment illustrated in FIG. 4 the coupling element 24 can be rotated over about one turn. For such a one-turn rotation of the coupling element 21, the screw-like element 24 has to be rotated over somewhat more than thirty turns. Preferably, one rotation of the screw-like element 24 over 360° causes the coupling element 21 to rotate over an angle of less than 36°, and more preferably over an angle of less than 18° (i.e. one turn of the coupling element requires preferably at least 10 turns, and more preferably at least 20 turns of the screw-like element).

By the use of a screw-like element 24 cooperating with the coupling element 21 to rotate it, only relatively little power is required to tension the torsion spring by rotating the screw-like element 24. Moreover, the screw-like element 24 the coupling element 21 is constantly blocked in a particular angular position with respect to the hinge shaft 10, even when adjusting the tension of the torsion spring 18 by rotating the screw-like element 24.

In order to render the door or gate 4 self-closing, the second hinge part 3 could be mounted or fixed (for example welded) irrotatably to the hinge shaft 10 so that opening the door or gate causes the hinge shaft 10 to rotate against the tension of the torsion spring 18 with respect to the first hinge part 2. A drawback of such a self-closing hinge is that when using it for a door or gate which can swing over a large angle, for example a (double) door or gate which can be opened in two directions namely in the normal opening direction against the action of the torsion spring and in the opposite direction, it was found that the torsion spring may get stuck in the coupling element due to the increasing diameter of the torsion spring when opening the door in the opposite direction. When the torsion spring gets stuck in the coupling element, there is a risk that the second end 20 of the torsion spring 18 may break of when further opening the door or gate, especially when the door or gate can be rotated over an angle of about 180° in both directions as in the illustrated embodiment.

To enable to rotate the door or gate also in the direction opposite the normal opening direction over an angle of about 180° without any risk of damaging the torsion spring, the second hinge part 3 is rotatably mounted in the illustrated embodiment on the hinge shaft 10, more particularly by inserting the cylindrical shaft 8 of the second hinge part 3 in the cylindrical hole 9 in the upper side of the hinge shaft 10.

In order to avoid that the torsion spring 18 may get stuck in the coupling element 21 rotation of the first hinge part 2 with respect to the hinge shaft 10 under the moment exerted by the torsion spring 18 on the first hinge part 2 is limited to a predetermined mutual angular position by mutually co-operating stop means on the first hinge part 2 and on the hinge shaft 10. The stop means on the first hinge part 2 comprise an abutment 32 on the upper surface of the top part 13 of the first hinge part 2. The stop means on the hinge shaft 10 comprise a plate-like element 33 which is fixed by means of screws 34 to the head 16 of the hinge shaft 10 and which rests upon the upper surface of the top part 13 of the first hinge part 2 so that the hinge shaft 2 is rotatably fixed to the first hinge part 2. The plate-like element 33 is substantially circular so that it can rotate along the abutment 32 on the first hinge part 2 but has a lateral projecting part 35 by means of which it abuts the abutment on the first hinge part to limit the rotation of the hinge shaft under the action of the torsion spring to a predetermined mutual angular position. In this position, the moment exerted by the torsion spring 18 on the first hinge part 2 is of a minimum value and increases when rotating the first hinge part 2 in a first rotational direction 37, i.e. in the opening direction of the door or gate, with respect to the hinge shaft 10.

Since the second hinge part 3 is rotatably connected to the hinge shaft 10 a further coupling between the second hinge part 3 and the hinge shaft 10 has to be provided so that the hinge shaft 10 is blocked with respect to the second hinge part 3 when opening the door or gate and the door or gate is thus opened against the moment exerted by the torsion spring on the first hinge part. This coupling comprises a stop formed by an upstanding lip 36 on the plate-like element 33 screwed onto the hinge shaft 10. This lip 36 engages the second hinge part 3 to limit, on the one hand, rotation of the hinge shaft 10 in the opening direction 37 with respect to the second hinge part 3 to a predetermined mutual angular position but to enable, on the other hand, rotation of the hinge shaft 10 with respect to the second hinge part 3 in a second rotational direction opposite the opening direction 37. Consequently, the door or gate can be opened in the normal opening direction against the moment exerted by the torsion spring 18 on the first hinge part 2 and can also be opened in the other direction without causing any further "uncoiling" of the torsion spring.

Figure 5:
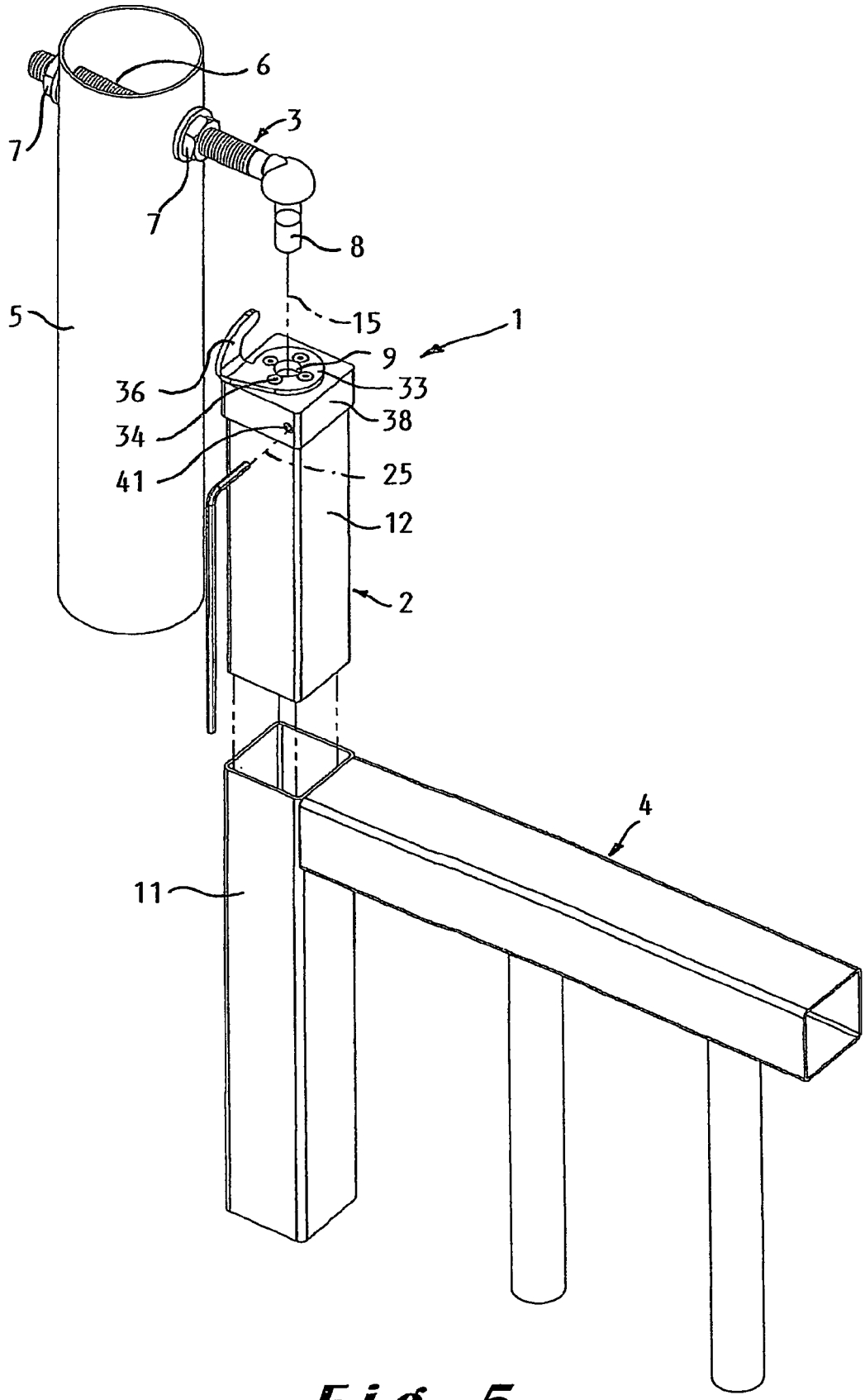
FIG. 5 is the same view as FIG. 1 but shows an adjustable self-closing hinge according to another embodiment of the invention.
Figure 6:
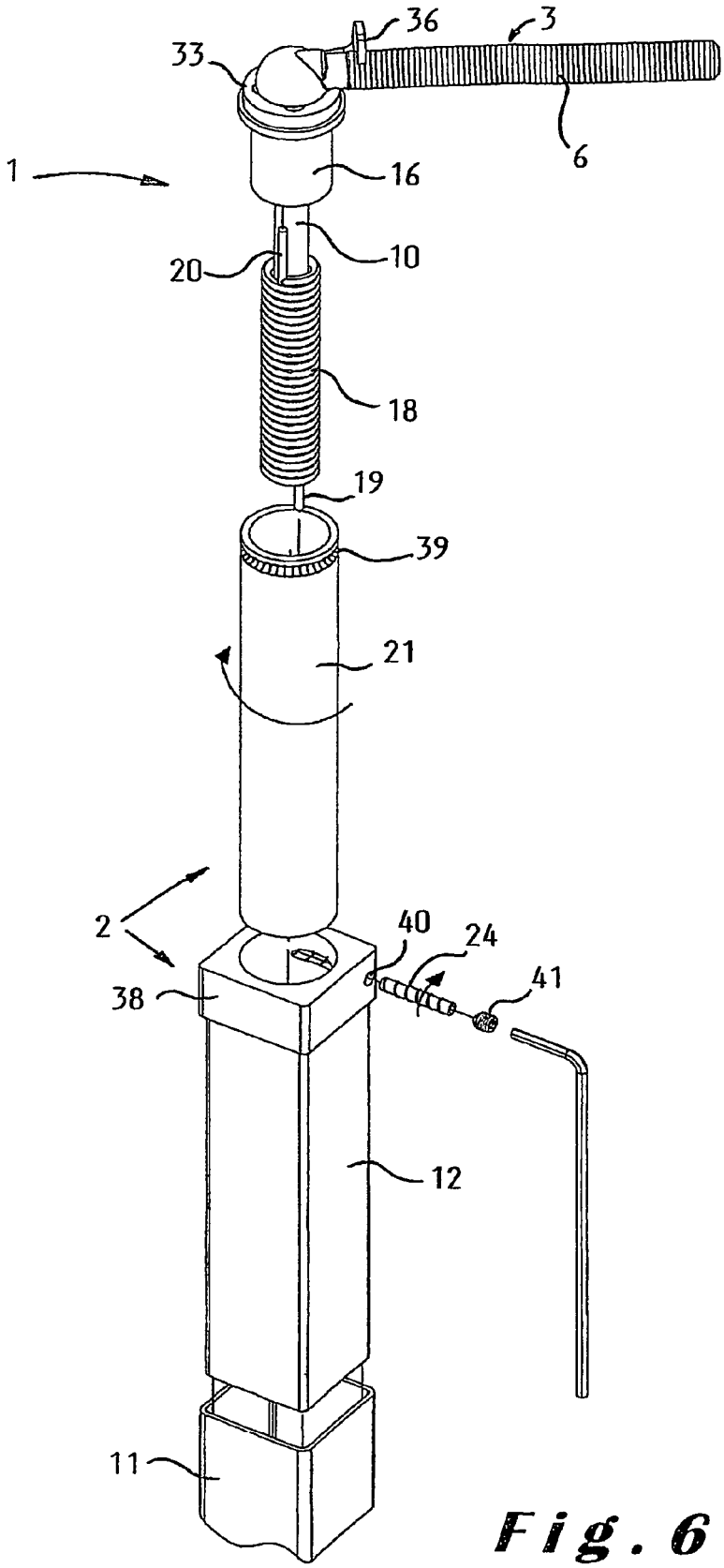
FIG. 6 shows an exploded view of the hinge illustrated in FIG. 5.

FIGS. 5 and 6 show another embodiment of an adjustable self-closing hinge according to the invention. This hinge comprises a first hinge part 2 formed by a tubular housing 12, a second hinge part 3, a coupling element 21 which fits rotatably in the first hinge part housing 12, a hinge shaft 10 having a head portion 16 fitting rotatably in the coupling element 21 and a torsion spring 18 arranged within the coupling element 21 around the hinge shaft 10 and having a first end 19 fixed to the coupling element 21 and a second end 20 fixed to the hinge shaft 10. In the same way as in the previous embodiment, the second hinge part 3 is rotatably mounted in the hinge shaft 10 and the hinge shaft is provided on top with a plate-like element 33 limiting the rotation of the hinge shaft 10 with respect to the first hinge part 2 and having an upstanding lip 36 engaging the second hinge part 3 when opening the door or gate 4 against the spring action of the torsion spring 18 and enabling to open the door or gate 4 in the opposite direction without further "uncoiling" the torsion spring 18.

As can be seen in FIG. 6, the construction of the coupling element 21 and of the screw-like element 24 is different from the construction of these elements in the previous embodiment. In the embodiment of FIGS. 5 and 6 the screw-like element is a worm 24 which can freely rotate in a hole 40 in an upper portion 38 of the first hinge part housing 12 and which co-operates with a worm wheel 39 provided on the upper side of the coupling element 21. Rotation of the worm 24 around its rotation axis 25, which is perpendicular to the hinge axis 15, causes the coupling element 21 to rotate around the rotation axis 23. The worm 24 also serves to fix the coupling element 21 in the first hinge part. The entry of the hole 40 is large enough to enable to insert the worm 24 in this hole after having inserted the coupling element 21 in the first hinge part housing 12. The entry of the hole 40 is moreover provided with an internal screw thread so that a small screw 41 can be screw therein until it abuts the worm 24 to prevent any movement of the worm 24.

From the above description it will be clear that the described embodiment can be amended in different ways without departing from the scope of the present invention as defined in the claims. For example instead of mounting the first hinge part into a vertical tubular member of the gate or door itself, it could also be mounted in a tubular element fixed for example by means of screws of by welding to a lateral side of the door or gate. Moreover, the first hinge part could be mounted in the same way against the support, in particular against the pole, to which the gate or door is to be suspended.

The hinge according to the invention enables to adjust the moment against which the door or gate can be opened. This moment can be adjusted in function of the personal preferences of the user. It also enables to overcome the typical spring fatigue problems associated with fixed-tension hinges. Adjusting the spring tension will also result in a different closing time. The hinge according to the invention can further be supplemented with a hydraulic or pneumatic device for adjusting the closing speed of the door or gate. Such a device can also be mounted in the tubular door or gate member.

The invention claimed is:

1. A gate or door closing hinge (1) comprising:

a first hinge part (2);

a second hinge part (3);

a hinge shaft (10) rotatably mounted about a first rotation axis (15) in the first hinge part (2) and connecting the first hinge part (2) to the second hinge part (3);

a torsion spring (18) having a longitudinal axis coinciding substantially with said first rotation axis (15) and having a first end (19) fixed with respect to the first hinge part (2) and a second end (20) fixed with respect to the hinge shaft (10) to exert a moment onto the first hinge part (2); and means (21, 24) for adjusting the moment exerted by the torsion spring (18) on the first hinge part (2), which adjusting means (21, 24) comprise:

a coupling element (21) which is interposed between the first end (19) of the torsion spring (18) and the first hinge part (2) and which is rotatably mounted in the first hinge part (2) about a second rotation axis (23) which coincides substantially with the first rotation axis (15); and a screw element (24) which is rotatably mounted in the first hinge part (2) about a third rotation axis (25) and which has a screw threaded portion (26) arranged to co-operate with the coupling element (21) to rotate the coupling element (21) with respect to the first hinge part (2) upon rotation of the screw element (24) about the third rotation axis (25) so as to adjust the moment exerted by the torsion spring (18) on the first hinge part (2), the coupling element (21) having a helical guide extending around the second rotation axis (23) and the screw element (24) co-operating with the coupling element (21) through the intermediary of a guided element (29) arranged to move along said helical guide (30) upon rotation of the screw element (24) to rotate the helical guide (30) and hence the coupling element (21) with respect to the first hinge part (2).

2. A hinge according to claim 1, characterised in that the third rotation axis (25) does not coincide with the first rotation axis (15).

3. A hinge according to claim 1, characterised in that the screw threaded portion (26) of the screw element (24) has such a step that, for one rotation of the screw element (24) over 360°, the coupling element (21) rotates over an angle of less than 36°.

4. A hinge according to claim 1, characterised in that said helical guide is a helical groove (30).

5. A hinge according to claim 1, characterised in that the guided element (29) has an internally screw-threaded hole (28) co-operating with the screw-threaded portion (26) of the screw element (24) to move the guided element (29) along the helical guide (30) upon rotation of the screw element (24).

6. A hinge according to claim 5, characterised in that the first hinge part (2) comprises a substantially linear guide (31) for said guided element (29), which linear guide (31) extends in a direction substantially parallel to the third rotation axis (25).

7. A hinge according to claim 1, characterised in that the third rotation axis (25) is substantially parallel to the first rotation axis (15).

8. A hinge according to claim 1, characterised in that rotation of the first hinge part (2) with respect to the hinge shaft (10) under the moment exerted by the torsion spring (18) on the first hinge part (2) is limited to a predetermined mutual angular position by mutually co-operating stop means (32, 35) on the first hinge part (2) and on the hinge shaft (10), the moment exerted by the torsion spring (18) on the first hinge part (2) being of a minimum value in said predetermined mutual angular position and increases when rotating the first hinge part (2) in a first rotational direction (37) with respect to the hinge shaft (10).

9. A hinge according to claim 8, characterised in that the hinge shaft (10) is rotatably mounted on the second hinge part (3), and the hinge shaft (10) is provided with a stop (36) for limiting rotation of the hinge shaft (10) in said first rotational direction (37) with respect to the second hinge part (3) to a predetermined mutual angular position and for enabling rotation of the hinge shaft (10) with respect to the second hinge part (3) in a second rotational direction opposite the first rotational direction (37).

10. A hinge according to claim 1, characterised in that the first hinge part (2) comprises a tubular housing (12) enclosing at least the hinge shaft (10), the torsion spring (18) and the coupling element (21).

11. A hinge according to claim 10, characterised in that the tubular housing (12) of the first hinge part (2) is arranged to be mounted in a tubular element fixed against the door or gate (4) or in a tubular frame member (11) of the gate or door (4) itself.

12. A hinge according to claim 10, characterised in that the screw threaded portion (26) of the screw element (24) has such a step that, for one rotation of the screw element (24) over 360°, the coupling element (21) rotates over an angle of less than 18°.

* * * * *